US006348832B1

(12) United States Patent
Chih

(10) Patent No.: US 6,348,832 B1
(45) Date of Patent: Feb. 19, 2002

(54) REFERENCE CURRENT GENERATOR WITH SMALL TEMPERATURE DEPENDENCE

(75) Inventor: Yue-Der Chih, Hsinchu (TW)

(73) Assignee: Taiwan Semiconductor Manufacturing Co., Inc. (TW)

( * ) Notice: Subject to any disclaimer, the term of this patent is extended or adjusted under 35 U.S.C. 154(b) by 0 days.

(21) Appl. No.: 09/550,666

(22) Filed: Apr. 17, 2000

(51) Int. Cl.[7] ..... G05F 1/10
(52) U.S. Cl. ..... 327/538; 327/513
(58) Field of Search ..... 327/513, 538, 327/351, 103, 378, 539, 543; 323/312, 315, 313

(56) References Cited

U.S. PATENT DOCUMENTS

| | | | | | |
|---|---|---|---|---|---|
| 4,803,541 | A | * | 2/1989 | Kouda | 357/68 |
| 5,448,103 | A | * | 9/1995 | de Wit | 257/536 |
| 5,828,110 | A | * | 10/1998 | Wollesen | 257/373 |
| 5,900,773 | A | * | 5/1999 | Susak | 327/539 |
| 6,046,491 | A | * | 4/2000 | Tamagawa | 257/538 |
| 6,104,277 | A | * | 8/2000 | Iniewski et al. | 338/311 |

* cited by examiner

*Primary Examiner*—Tuan T. Lam
*Assistant Examiner*—Hiep Nguyen
(74) *Attorney, Agent, or Firm*—Baker Botts LLP

(57) ABSTRACT

The current generator circuitry for providing a reference current with small temperature dependence feature is disclosed. The circuitry comprises two PMOS transistors, two NMOS transistors, two diode, as well as two resistors. The first PMOS and NMOS transistors as well as the first diode are in series connected between a power reference and a potential reference. It flows with a primary current. The second PMOS transistor has a gate terminal connected to a gate of the first PMOS transistor thereto connect to a drain terminal of the second PMOS transistor. Furthermore, the second NMOS transistor has a gate terminal connected to a gate of the first NMOS transistor thereof connecting to a drain terminal of the first NMOS transistor. The second PMOS transistor, the second NMOS transistor, the second diode, the first resistor and the second resistor are in series connected between above power reference and the potential reference to flow a reference current. Worth to note, the first resistor has a small temperature coefficient and the second resistor has a large temperature coefficient so that the temperature coefficient of the resistance is close to a critical value, 3.33E-3. As a result the reference current generator has a feature of very small temperature dependence.

11 Claims, 1 Drawing Sheet

REFERENCE CURRENT GENERATOR WITH SMALL TEMPERATURE DEPENDENCE

BACKGROUND OF THE INVENTION

1. Field of the Invention

The present invention relates to a current generator circuitry and more particularly, to a reference current generator capable of providing a reference current with substantially small temperature dependence by using two kinds of resistance, which have different temperature coefficients.

2. Description of the Prior Art

In an integrated circuit a number of amplifier stages are coupled to a constant dc current generated at one location and reproduced at many other locations for biasing the different transistors in the circuit. A popular circuit building block for accomplishing current reproduction is the current mirror showing in FIG. 1. It consists of four matched transistors M1, and M2, M3, and M4 as well as two diodes D1, D2 and one resistor R1. The PMOS transistor M2, NMOS transistor M4 and diode D1 are in series connected and coupled between a voltage supply and a first reference voltage. On the other hand, the PMOS transistor M1, NMOS transistor M3 resistor R1 and diode D1 are in series connected in a similar way and coupled between the voltage supply and a second reference voltage. The second reference voltage can optionally the same as the first reference voltage. The gates of the PMOS transistors M2 and M1 are connected each other and also connected to a drain of the PMOS transistor M1. Moreover, the gates of the NMOS transistors M3 and M4 are connected together and also to a drain of the NMOS transistor M4 so that it ensures NMOS transistor M4 in the active mode.

The reference current $I_{ref}$ generated can be expressed as $$I_{ref}=(kT/q*In(A_2/A_1))/R_1, \quad (1)$$

Where k is the Boltzmann's constant, T is absolute temperature, and q is the electric charge, and A1 and A2 are the diode areas of D1 and D2, respectively. In the equation (1), the resistance R1 is inherently temperature dependent and has temperature coefficient Tc. Thus the current $I_{ref}$ has a temperature dependent not only on the term kT/q but also on the denominator, the resistance R1. While designing a current generator, it is of great vital that the current generator $I_{ref}$ is independent from the power supply as well as the temperature variations.

An object of the invention is thus to solve aforementioned issues.

SUMMARY OF THE INVENTION

The current generator circuitry for providing a reference current with small temperature dependence feature is disclosed. The circuitry comprises a first and a second PMOS transistor, a first and a second NMOS transistor, a first and a second diode, as well as a first and a second resistors. The first PMOS transistor, the first NMOS transistor and the first diode are in series connected between a power reference and a potential reference. It flows with a primary current. The second PMOS transistor has a gate terminal connected to a gate of the first PMOS transistor thereto connect to a drain terminal of the second PMOS transistor. Furthermore, the second NMOS transistor has a gate terminal connected to a gate of the first NMOS transistor thereof connecting to a drain terminal of the first NMOS transistor. The second PMOS transistor, the second NMOS transistor, the second diode, the first resistor and the second resistor are in series connected between the power reference and the potential reference to flow a reference current. Worth to note, the first resistor has a small temperature coefficient and the second resistor has a large temperature coefficient so that the average temperature coefficient is close to a critical value, 3.33E-3. As a result the reference current generator has a feature of very small temperature dependence.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Since the current generated by the aforementioned prior art is found to be temperature variation dependent. Most of the conventional method to solve above issue is to design, for instance, a circuit with a negative temperature coefficient to compensate the circuit with a positive temperature coefficient. As a consequence, a complicated circuit is anticipated.

The present invention provides a simple and effective method to simply the circuit required.

The concept of the invention comes from the temperature dependence of the resistor in denominator of equation (1) and dependence of the numerator, the term kT/q. As is known, to determine the first derivative of the equation (1) can obtain the extreme value of the temperature coefficient so as to make an appropriate resisto, which has a desired temperature coefficient.

Rewrite equation (1) $I_{ref}=(kT/q*In(A_2/A_1))/R$ as Iref=AT/R, where A represents the constant portion, k/q $In(A_2/A_1)$.

Hence, to determine first derivative of equation (1)

$$\rightarrow d\ Iref/dT=d/dt(AT/R)=0;$$

$$\rightarrow A/R+AT(-1/R2)dR/dT=0;$$

$$\rightarrow R/T=dR/dT \quad (2);$$

Since resistor R is temperature dependent, assume $R=R_0$, for $T=T_0$ and the first order approximation of the resistive would be $R=R_0(1+Tc(T-T_0))$ (3), while T varies from $T_0$.

Substitute (3) into (2), it thus obtains $1/T_0=Tc$.

For $T_0=300$ K, a temperature for which the resistance is measured.

$$\rightarrow Tc\approx 1/T_0=3.33E\text{-}3.$$

That is, if the resistor has an ideal temperature coefficient $3.33\times10^{-3}$, the reference current generator would be temperature insensitive around T=300 K. However, for a typical n-well resistance, it has a temperature coefficient 5E-3.

Figure 2:
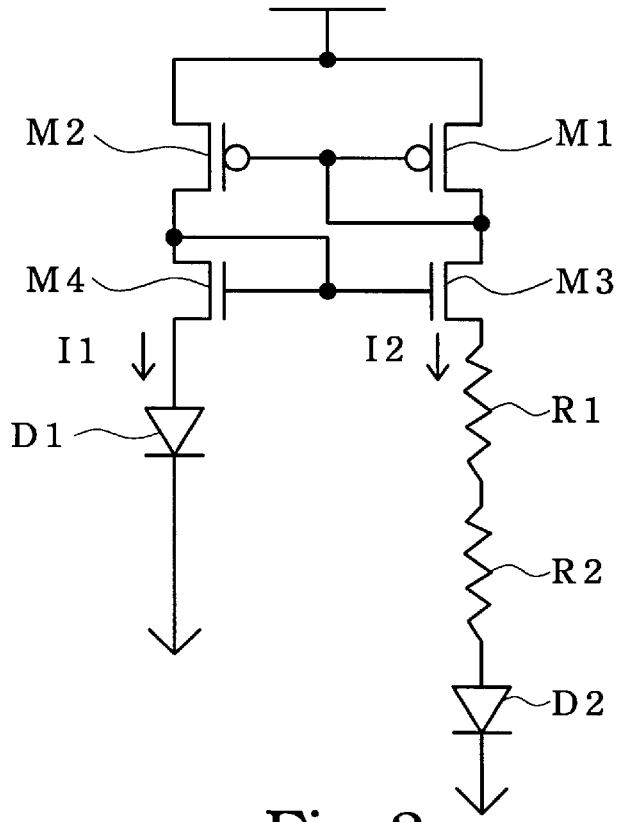
FIG. 2 shows reference current generator circuitry in accordance with the present invention.

To make the reference current generator having minimum temperature dependence, the present invention proposes a circuit as shown in FIG. 2.

Figure 1:
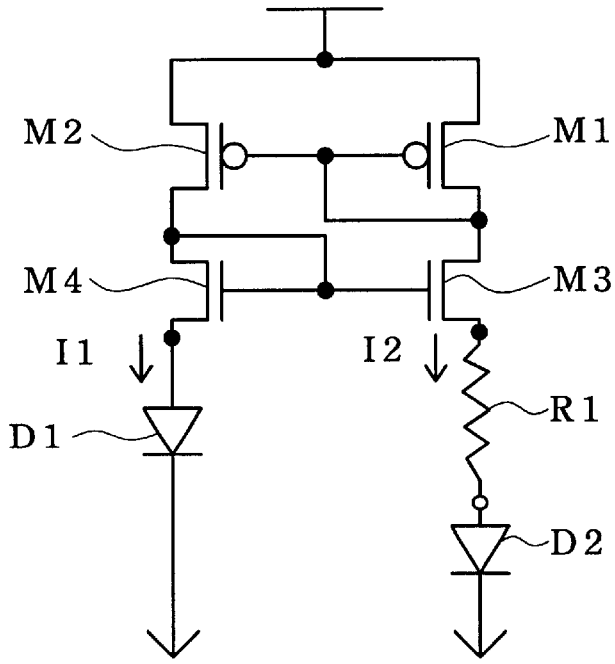
FIG. 1 is reference current generator circuitry in accordance with the prior art.

As that shown in FIG. 2, a preferred embodiment of the present invention has PMOS transistors M2, M1, NMOS transistors M4, M1, and diodes D1, D2, all connected as before. What are different between FIG. 1 and FIG. 2 are two resistors R1 and R2 instead of a single resistor R1 being connected between NMOS transistor M3 and the second diode D2. In a preferred embodiment, the resistors R1 and R2, one has a temperature coefficient larger than 3.33E-3 and the other has a value smaller than 3.33E-3 in a first order approximation. The position of the two resistors can be exchanged without affecting the results. Two resistors can have different or have the same $R_0$ for a measurement is done at same $T_0$. Preferably, the R1 is a n-well resistance and R2 is a p+ diffusion resistance. The resistance may also be formed of the doped polysilicon resistance, n+ diffusion resistance, or p-well resistance. Two or above resistors combination can make the temperature coefficient being close or equal to 3.33E-3 so that the temperature dependence of the reference current generator comes to minimum. For the purpose to illustrate this, let $R1=R2=R_0$ at a standard measuring temperature $T_0$. The first order approximation of R1 can be express as:

$$R1=R_0(1+T_{C1}(T-T_0)) \quad (4)$$; and R2 can be express as:

$$R2=R_0(1+TC\ 2(T-T_0)) \quad (5)$$

Substitute (4) and (5) into (2), it is observed that $(T_{C1}+T_{C2})/2=1T_0$.

In other words, the combination of resistors with bigger and smaller temperature coefficients results in an average temperature coefficient having an opportunity to make it close to or equal to 3.33E-3. Table 1 lists various parameters so as to compare the temperature dependence of the present invention with that of the prior art.

It shows the manufacture parameters about transistors, diode area, resistors with respective temperature coefficient to compare the reference current of the conventional circuitry with the present invention.

TABLE 1

| parameter | Conventional circuitry | Invention's circuitry |
|---|---|---|
| W/L of M1,M2 | 15 μm/1.2 μm | 15 μm/1.2 μm |
| W/L of M3,M4 | 20 μm/1 μm | 20 μm/1 μm |
| A2/A1 | 10 | 10 |
| R or R1 (n-well resistance) | 2.5 kΩ | 1.25 kΩ |
| R2(p + diffusion resistance) | * | 1.25 kΩ |
| Temperature coefficient of R or R1 | $T_{C1}$ = 5.07E-3 for n-well resistance | $T_{C1}$ = 5.07E-3 for n-well resistance |
| Temperature coefficient of R2 | | $T_{C2}$ = 1.44E-3 for p + diffusion resistance |
| Iref at T = 0° C. | 67.2857 μA | 67.2825 μA |
| Iref at T = 25° C. | 64.1950 μA | 64.1945 μA |
| Iref at T = 85° C. | 56.1985 μA | 64.0622 μA |
| Iref at T = 0° C. | 51.6673 μA | 64.0011 μA |
| Temperature dependence | −1952 ppm/° C. | −35.1 ppm/° C. |

From the parameter list in the table 1, it is observed that two or above parameters is indeed reduce the temperature dependence of the reference current generator.

The benefit of the present invention required only two kinds of resistors to make the temperature coefficient approaching 3.33E-3 without more extra devices.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A reference current generator having temperature dependence, comprising:

a first PMOS transistor, a first NMOS transistor;

a first diode, wherein said first PMOS transistor, said first NMOS transistor and said first diode are in series connected and coupled between a power reference and a potential reference;

a second PMOS transistor having a gate terminal connected to a gate of said first PMOS transistor and thereto connected to a drain terminal of said second PMOS transistor;

a second NMOS transistor having a gate terminal connected to a gate of said first NMOS transistor and thereto connected to a drain terminal of said first NMOS transistor;

a plurality of resistors each having a respective temperature coefficient and having a respective resistance, among of said resistors having temperature coefficients thereof average to about $1/T_0$ for reducing the temperature dependence of the reference current generator, wherein said $T_0$ is an operation temperature for which said resistance is measured; and a second diode, said second PMOS transistor, said second NMOS transistor, said second diode, said second diode, and said plurality of resistors are in series connected between said power reference and said potential reference.

2. The reference current generator of claim 1, wherein said plurality of resistors are formed by significantly different impurity dosage in single crystal silicon or polysilicon.

3. The reference current generator of claim 1, wherein said plurality of resistors comprises a n-well resistance.

4. The reference current generator of claim 1, wherein said wherein said plurality of resistors comprises a p+ diffusion resistance.

5. The reference current generator of claim 1, wherein said plurality of resistors comprises a n-well resistance and a p+ diffusion resistance.

6. The reference current generator of claim 1, wherein said plurality of resistors are selected from the group consisting of p+ diffusion resistance, n+ diffusion resistance, n-well resistance, and p-well resistance.

7. The reference current generator of claim 2, wherein said n-well resistance has a temperature coefficient larger than 3.33E-3 in the first order approximation, and said p+ diffusion resistance has a temperature coefficient lower than 3.33E-3.

8. A reference current generator having temperature dependence, comprising:

a first PMOS transistor;

a first NMOS transistor;

a first diode, wherein said first PMOS transistor, said first NMOS transistor and said first diode are in series connected between a power reference and a potential reference;

a second PMOS transistor having a gate terminal connected to a gate of said first PMOS transistor and thereto connected to a drain terminal of said second PMOS transistor;

a second NMOS transistor having a gate terminal connected to a gate of said first NMOS transistor and thereto connected to a drain terminal of said first NMOS transistor;

a first resistor having a first temperature coefficient and a first resistance;

a second resistor having a second temperature coefficient and a second resistance, said first temperature coefficient being higher than 3.33E-3 and said second temperature coefficient being lower than 3.33E-3, wherein said temperature coefficients average to about 3.33E-3 for reducing the temperature dependence of the reference current generator where the first and the second resistances are measured at 300 K; and a second diode, said second PMOS transistor, said second NMOS transistor, said second diode, said second diode, said first resistor and said second resistor are in series connected between said power reference and said potential reference.

9. The reference current generator of claim 8, wherein said first resistor and said second resistor are formed by significantly different impurity dosage.

10. The reference current generator of claim 9, wherein said first resistor is a resistor formed of a n-well resistance.

11. The reference current generator of claim 9, wherein said second resistor is a resistor formed of a p+ diffusion resistance.

* * * * *